US008712489B2

(12) United States Patent
Schauwecker et al.

(10) Patent No.: US 8,712,489 B2
(45) Date of Patent: Apr. 29, 2014

(54) METHOD FOR MANUFACTURING A MAGNET COIL CONFIGURATION USING A SLIT BAND-SHAPED CONDUCTOR

(75) Inventors: Robert Schauwecker, Zurich (CH); Robert Herzog, Zurich (CH); Riccardo Tediosi, Zurich (CH); Matteo Alessandrini, Zurich (CH)

(73) Assignee: Bruker BioSpin AG, Faellanden (CH)

( * ) Notice: Subject to any disclaimer, the term of this patent is extended or adjusted under 35 U.S.C. 154(b) by 43 days.

(21) Appl. No.: 13/602,221

(22) Filed: Sep. 3, 2012

(65) Prior Publication Data

US 2013/0065767 A1 Mar. 14, 2013

(30) Foreign Application Priority Data

Sep. 14, 2011 (DE) ..... 10 2011 082 652

(51) Int. Cl.
*H01F 6/00* (2006.01)

(52) U.S. Cl.
USPC ..... 505/211

(58) Field of Classification Search
CPC ..... H01F 6/06
USPC ..... 505/211
See application file for complete search history.

(56) References Cited

U.S. PATENT DOCUMENTS

| | | | | |
|---|---|---|---|---|
| 7,566,684 | B1 | 7/2009 | Levin | |
| 8,436,499 | B2 * | 5/2013 | Zhang et al. | 310/52 |
| 2008/0207458 | A1 * | 8/2008 | Hong et al. | 505/238 |

FOREIGN PATENT DOCUMENTS

| | | |
|---|---|---|
| DE | 102010042598 | 4/2012 |
| GB | 1379010 | 1/1975 |
| JP | 06216565 | 8/1994 |
| JP | 2001176338 | 6/2001 |
| WO | WO 2007/004787 | 1/2007 |

OTHER PUBLICATIONS

J. Kosa et al., "Application Possibilities with Continuous YBCO Loops Made of HTS Wire", Journal of Physics: Conference Series 234 (2010) 032030.

Janos Kosa et al., "Fault current limiter with novel arrangement of perfect YBCO loops made of HTS wire, 14th International Power Electronics and Motion Control Conference 2010", Pa. T10-69 to T10-73, EPE-PEMC 2010.

* cited by examiner

*Primary Examiner* — Colleen Dunn
(74) *Attorney, Agent, or Firm* — Paul Vincent

(57) ABSTRACT

A magnet coil configuration (20-24) is manufactured from a band-shaped conductor (1), which is slit in the longitudinal direction except for its two end areas (2, 3) such that the band-shaped conductor (1) has a first and a second half band (4, 5) and two end areas (2, 3) which connect these two half bands (4, 5) to form a closed loop. The two half-bands (4,5) of the slit band-shaped conductor (1) are initially wound onto two separate intermediate coils (14,15) and the final coil structure is subsequently wound by alternate extraction of the two half-bands (4,5) from the intermediate coils (14,15). A simple method is thereby proposed for winding a slit band-shaped conductor to form a magnet coil configuration which also generates strong magnetic fields.

20 Claims, 13 Drawing Sheets

METHOD FOR MANUFACTURING A MAGNET COIL CONFIGURATION USING A SLIT BAND-SHAPED CONDUCTOR

This application claims Paris Convention priority of DE 10 2011 082 652.1 filed Sep. 14, 2011 the entire disclosure of which is hereby incorporated by reference.

BACKGROUND OF THE INVENTION

The invention concerns a method for manufacturing a magnet coil configuration using a band-shaped conductor, which is slit in the longitudinal direction except for its two end areas such that the band-shaped conductor has a first and a second half band and two end areas that connect these half bands to form a closed loop.

A method of this type is disclosed in WO 2007/004787 A2.

Superconducting magnet coils are used for generating strong magnetic fields. The current that flows in the superconducting magnet coils is thereby practically carried without ohmic losses. Magnet coils that are wound with wires made from conventional low-temperature superconductors (LTS) such as NbTi or $Nb_3Sn$ have been used in a plurality of ways in practice, in particular, in NMR spectroscopy and imaging NMR. The magnetic field strength thereby limits the respective resolution.

In order to further increase the magnetic field strength that can be generated, it is globally tried to use high-temperature superconductors (HTS) in superconducting magnet coils. In comparison with LTS materials, HTS materials basically provide higher magnetic field strengths (also more than 20 Tesla) at the same low temperature (in most cases around 4 K). At higher temperatures (approximately 15 to 50K), at which typical LTS materials are already normally conducting, HTS materials still generate high field strengths (5 to 15 Tesla).

However, HTS materials generally have ceramic properties and have a layered crystal structure. The properties of the HTS materials (including the current carrying capacity) highly depend on the direction relative to the orientation of the layered crystal (anisotropy). Up to now, it has turned out to be advantageous in practice to use HTS materials in layers (often in the form of very thin layers) as part of band-shaped conductors.

In recent years, the manufacture and the quality of band-shaped HTS conductors, in particular, of the so-called YBCO-coated conductors could be considerably improved. For this reason, winding configurations and winding methods that are suited for band-shaped conductors, are becoming more important for the manufacture of magnet coils using HTS materials.

Some high-field applications require short-circuited superconducting magnet coils with extremely small loop resistance (typically smaller than 10 pΩ). However, these small loop resistances cannot be realized at present with superconducting joints (also called splices) of band-shaped HTS conductors.

WO 2007/004787 A2 discloses a way of bypassing the connection problem of bands with a continuous superconducting layer by means of a slit along the band. The half bands generated in this fashion are connected via non-slit end areas such that a continuous loop is generated for a superconducting current path. WO 2007/004787 A2 proposes winding of one flat coil with each half band to configure one superconducting electromagnet. One of the flat coils is subsequently rotated through 180° such that the magnetic fields of the two flat coils add during operation. In this connection, at least one of the half bands is substantially twisted in the two end areas.

The resulting mechanical stress can damage the conductor, thereby impairing the current-carrying capacity and therefore also reducing the magnetic field that can be achieved. For larger solenoid-like coils, this document proposes to slit the band several times in the longitudinal direction and to wind one flat coil for each partial band.

J. Kosa et al. "Application Possibilities with Continuous YBCO Loops Made of HTS wire", Journal of Physics: Conference Series 234 (2010), 032030, disclose a winding configuration for a band-shaped superconductor that is slit in its longitudinal direction except for its end areas, wherein the end areas are not twisted. Several serial loops are thereby formed from a conductor loop, which are then guided through each other. This method is difficult and only practicable for a small number of loose windings, and is, in particular, not suited for providing windings on a winding body.

U.S. Pat. No. 7,566,684 discloses a method, wherein two branches of a slit tape are wound onto a single mandrel, resulting in a double pancake coil. The branches are only linked at one end and do not form a closed conductor loop.

It is the underlying purpose of the invention to provide a simple method for winding a slit band-shaped conductor to form a magnet coil configuration which can also generate strong magnetic fields.

SUMMARY OF THE INVENTION

This object is achieved by a method of the above-mentioned type, which is characterized by the following steps:

a) the first half band of the slit band-shaped conductor is wound onto a first intermediate coil and the second half band of the slit band-shaped conductor is wound onto a second intermediate coil;

b) sub-steps of type b1) and type b2) are alternately performed comprising b1) one or more windings of the first half band are wound from the first intermediate coil onto a winding body of the magnet coil configuration, and b2) one or more windings of the second half band are wound from the second intermediate coil onto the same winding body.

The inventive method offers a winding method which can be easily performed by a machine and by means of which the two half bands of a slit conductor can be wound onto a common winding body (also called winding core). Towards this end, each of the two half bands is initially rewound onto one intermediate coil in step a). In this fashion, it is possible to alternately wind one or more windings of the first half band and one or more windings of the second half band onto the same winding body in a simple fashion during the subsequent actual winding process of the magnet coil configuration in step b). This method produces a compact magnet configuration which carries both half bands and is therefore suited for particularly strong magnetic fields.

The inventive method enables virtually arbitrary distribution of windings of the two half bands onto the common winding body. In particular, the windings of both half bands can be easily arranged on the winding body such that the magnetic fields generated by the two half bands completely add. It is also possible to produce layers with a plurality of helically wound windings. For this reason, the magnet configuration can also generate axially extended magnetic fields of high homogeneity.

The band-shaped conductor is typically superconducting. The band-shaped conductor preferably has a high-temperature superconducting material (e.g. YBCO). HTS materials having a transition temperature of more than 40K are particularly preferred.

At least one substep of type b1) and one substep of type b2) are performed within the scope of step b) such that at least one change between the substeps is necessary. A change from a substep of type b1) to a substep of type b2) (or vice versa) includes a change of the intermediate coil to be unwound. The intermediate coil to be unwound is thereby preferably changed after an even number of windings.

One layer designates a plurality of axially neighboring windings which are wound on the winding body at the same radius (directly or also on a previously wound layer on the winding body) over at least one part of the axial length of the winding body, wherein the neighboring windings are (directly) electrically and mechanically connected in series. The windings are typically helically wound within one layer. A circular winding through almost 360° with an S-shaped wire segment ("wiggle") that connects two respective neighboring windings across the remaining angular section is also feasible. It should be noted that the winding body (and also the intermediate coils) may have a circular cross-section or also a different cross-section, such as e.g. a square or polygonal cross-section. The term winding radius generally defines the separation from the magnetic center of the winding configuration perpendicular to the direction of the magnetic field.

One preferred variant of the inventive method includes at least two, preferably at least four changes between the substeps of type b1) and type b2), thereby also realizing more complex winding sequences. In particular, approximately identical lengths of the two half bands may be wound (when the overall number of windings of the two half bands is the same).

In one advantageous variant, the two half bands are each helically wound onto the intermediate coils with a plurality of axially neighboring windings in step a), in particular, wherein the circumferences of the two intermediate coils are chosen to be identical or almost identical to the circumference of the winding body. The helical/layered winding of the intermediate coils is advantageous, since the winding radius varies less during unwinding compared to flat coils. The circumferences of all three coils should be approximately the same during the entire actual winding process (step b) (irrespective of the type of winding of the half bands onto the intermediate coils) to ensure that the intermediate coils substantially do not rotate about their own axes during motion on a circular path around the winding body. When the winding body rotates, the winding body and the active intermediate coil should rotate as synchronously as possible without substantially changing their separation from each other. The circumferences of the intermediate coils and of the winding body preferably differ by maximally 1%, preferably maximally 0.5%, preferably maximally 0.2% taking into consideration the thickness of the wound layers at any point in time of the actual winding process (step b). When a sufficiently small number of layers have been wound on top of each other and/or when the band thicknesses are small, the wound layers can be neglected and the occurring winding radius differences need not be compensated for. Intermediate coil circumference and winding body circumference (in each case without wound layers) are generally selected to be identical or with a maximum difference of 1%, preferably 0.5% and preferentially 0.2%. The cross-sections of the intermediate coils and of the winding body are preferably selected to be circular.

In one particularly preferred variant, the two intermediate coils are wound at the same time in step a), in particular, wherein the two intermediate coils are arranged coaxially or almost coaxially and are rotated in a synchronous fashion. Simultaneous winding of the two intermediate coils generally renders intermediate storage of half bands unnecessary. For a coaxial configuration and synchronous rotation, one single drive (in most cases an electromotor) can be used for both intermediate coils. The two half bands are typically wound onto the two rotating intermediate coils in axially opposite directions with respect to the pitch direction.

In another preferred method variant, an end area that connects the two half bands moves between the two half bands during each rotation of the intermediate coils in step a). The end area of the band-shaped conductor ("double band"), with which rewinding onto the intermediate coils is started, is applied to the two intermediate coils in such a fashion that the end area slips once through the slit of the double band during each rotation of these coils. This generates the topologically necessary twisting of the two half bands during rewinding. It should be noted that the intermediate coils typically rotate in a synchronous fashion.

In one advantageous variant, in at least one substep in step b), a plurality of axially neighboring windings are helically wound onto the winding body to form at least one layer, in particular, having at least five axially neighboring windings per layer. Helical winding yields higher winding number densities compared e.g. to stacking several flat coils. The number of changes between substeps can be reduced by winding in layers.

It should be noted that basically any part of all substeps can be selected for this variant (and the following variants), or even all substeps irrespective of the type.

In one advantageous further development of this variant, in at least one substep of step b), one or more double layers of the half band are wound from the respective intermediate coil onto the winding body of the magnet coil configuration. The two layers of a respective double layer are directly wound on top of each other (without intermediate layer of the other half band), wherein the axial winding direction reverses between the two layers of the double layer (winding "forwards and backwards"). For this reason, the start and the end of a double layer may be located at the same axial position (typically at an axial end of the magnet coil configuration), thereby facilitating the overall process. Knottings of the half bands are prevented.

In another advantageous further development of the above method variant, one or more layers are wound onto the winding body across the full axial length thereof in at least one substep of step b). This prevents axial half band changes within the length of the winding body, thereby reducing the mechanical stress on the conductor in individual cases.

In another further development of the above-mentioned method variant, one or more layers are wound onto the winding body only over a section of the axial length of the winding body in at least one substep b1) of step b), and one or more layers are wound only over a further section of the axial length of the winding body in at least one substep b2) of step b). This embodiment permits more degrees of freedom for the distribution of the windings of the two half bands in the magnet coil configuration. The first section and the further section do not overlap in the axial direction. The axial length of the winding body may basically be divided into any number of sections (in particular also three or more), which each have their own winding packages.

In another further development of the above-mentioned method variant, layers of the first and of the second half band are radially wound onto the winding body on top of each other in step b). For this reason, the windings of the various half bands can generate a magnetic field in an axially identical area.

In another particularly preferred method variant, the two half bands are twisted with respect to each other in one of the end areas prior to step a), in particular through a total of 180°, and are applied in this twisted form to the intermediate coils for winding, and the intermediate coils are tilted with respect to each other after step a) in such a fashion that twisting of the half bands in this end area is cancelled again. For this reason, the half bands of the completely wound magnet coil configuration are not twisted. The correspondingly reduced mechanical stress on the half bands increases the current-carrying capacities and therefore increases the magnetic field strengths. Previous twisting prior to and during step a) does not damage the band-shaped conductor when the feed length is sufficiently long (e.g. between a storage coil and the two intermediate coils). The feed length is typically at least 50 times longer than the width of a half band.

In another preferred variant, in step a), the slit band-shaped conductor is unwound from a storage coil, on which the two half bands are arranged axially next to each other, in particular, wherein the storage coil is a flat coil. This facilitates the rewinding process. The band-shaped conductor may alternatively also be slit directly prior to rewinding onto the intermediate coils, e.g. through laser cutting.

In another preferred method variant, the intermediate coils and the winding body are oriented at least substantially in parallel during step b). This largely prevents tilting of the half band during rewinding.

In one particularly preferred method variant, in each substep of type b1) and type b2)

one of the intermediate coils is arranged coaxially with respect to the winding body and mechanically coupled to the winding body, and the other intermediate coil is arranged parallel with respect to the winding body at a radial separation therefrom, a half band is rewound from the other intermediate coil onto the winding body through rotation of the winding body together with one intermediate coil and synchronous rotation of the other intermediate coil, wherein, with each rotation of the winding body, a band section that interconnects the two winding coils is guided once axially outside past the winding body on the side facing away from one intermediate coil, and is guided once axially outside past the other intermediate coil on the side facing the one intermediate coil. This variant can be realized using a relatively small amount of space and is based on rotations of the coils that are easy to perform. The winding body including one of the intermediate coils are thereby preferably held and driven on the axial side of one intermediate coil facing away from the winding body, whereas the other intermediate coil is held and driven on its axial side facing away from one intermediate coil. During a change between substeps b1) and b2), two of the three coils (in most cases the intermediate coils) are typically spatially displaced. All of the three coils (the axes thereof) are preferably horizontally aligned. The band section, which connects the two intermediate coils, typically comprises one of the end areas of the conductor. The band section, which connects the two intermediate coils, may be guided by means of a bracket which is mounted to the other intermediate coil and rotates together therewith, wherein the bracket also pivots about the winding body during one circulation, thereby surrounding it axially from the side on the side facing away from the intermediate coil.

In another preferred method variant, in each of the substeps of type b1) and type b2)

one of the intermediate coils is guided on a circular path relative to the winding body, while the other intermediate coil remains at rest, wherein, with each circulation, one band section of the conductor, which connects the two intermediate coils, is axially guided past the outside of the winding body, and wherein with each circulation, one intermediate coil is axially guided on the inside past a band section of the conductor, which connects the other intermediate coil and the winding body. The winding body is typically stationary and the intermediate coils alternately circulate around the winding body. The band section of the conductor, which connects the two intermediate coils, typically comprises one of the end areas of the conductor. Guidance of the band section can be facilitated by using a bracket that is mounted to the winding body. The axes of the coils are all aligned in a vertical direction or all in a horizontal direction. In this variant, only one coil moves at any time, which may facilitate process control in individual cases.

The present invention also concerns a magnet coil configuration made from a band-shaped conductor, which is slit in the longitudinal direction except for its two end areas such that the band-shaped conductor has a first and a second half band and two end areas that connect these two half bands to form a closed loop, which is characterized in that at least one winding of the first half band and at least one winding of the second half band are wound onto a common winding body, in particular, wherein the magnet coil configuration is wound using an inventive method as described above. The inventive magnet coil configuration is easy to produce by machines. The magnet coil configuration is generally superconducting. It is preferably operated in a superconducting short-circuited mode ("persistent mode"), thereby generating high and time-constant magnetic fields. Inventive magnet coil configurations can be used, in particular, in NMR spectroscopy and imaging NMR.

In one preferred embodiment of the inventive magnet coil configuration, the slit band-shaped conductor comprises high-temperature superconducting material, in particular, wherein the band-shaped slit conductor is a YBCO-coated conductor. The use of HTS materials enables generation of particularly high magnetic field strengths or operation at comparatively high temperatures, thereby reducing the cooling expense (for example by cooling using inexpensive liquid nitrogen instead of expensive liquid helium).

In one preferred embodiment, the two half bands are helically wound in layers onto the winding body, wherein each layer comprises a plurality of axially neighboring windings, in particular, at least five axially neighboring windings. This enables straightforward production of magnet coil configurations which have a solenoid-like shape and can generate strong magnetic fields of high homogeneity in an extended area.

In another advantageous embodiment, layers of the first and of the second half band are radially wound onto the winding body on top of each other. This obtains excellent overlapping of the magnetic fields of the windings of the first and the second half band and therefore a particularly high magnetic field strength.

In another particularly preferred embodiment, the radial sequence of layers of the first half band and of the second half band are selected in such a fashion that approximately identical lengths of the first half band and of the second half band are wound in the layers of the magnet coil configuration, in particular, wherein the radial sequence contains one or more sections, in which N layers of the first half band, subsequently 2N layers of the second half band, and subsequently again N layers of the first half band are arranged in radial sequence, with N: basic number of layers of the section, wherein N∈IN. Slitting of a band-shaped conductor generally produces identical half band lengths. When the lengths of the half bands that have been wound are identical, there are no disturbing residual unwound sections of a half band.

Further advantages of the invention can be extracted from the description and the drawing. The features mentioned above and below may be used in accordance with the invention either individually or collectively in arbitrary combination. The embodiments shown and described are not to be understood as exhaustive enumeration but have exemplary character for describing the invention.

The invention is illustrated in the drawing and is explained in more detail with reference to embodiments. In the drawing:

DESCRIPTION OF THE PREFERRED EMBODIMENT

Figure 1:
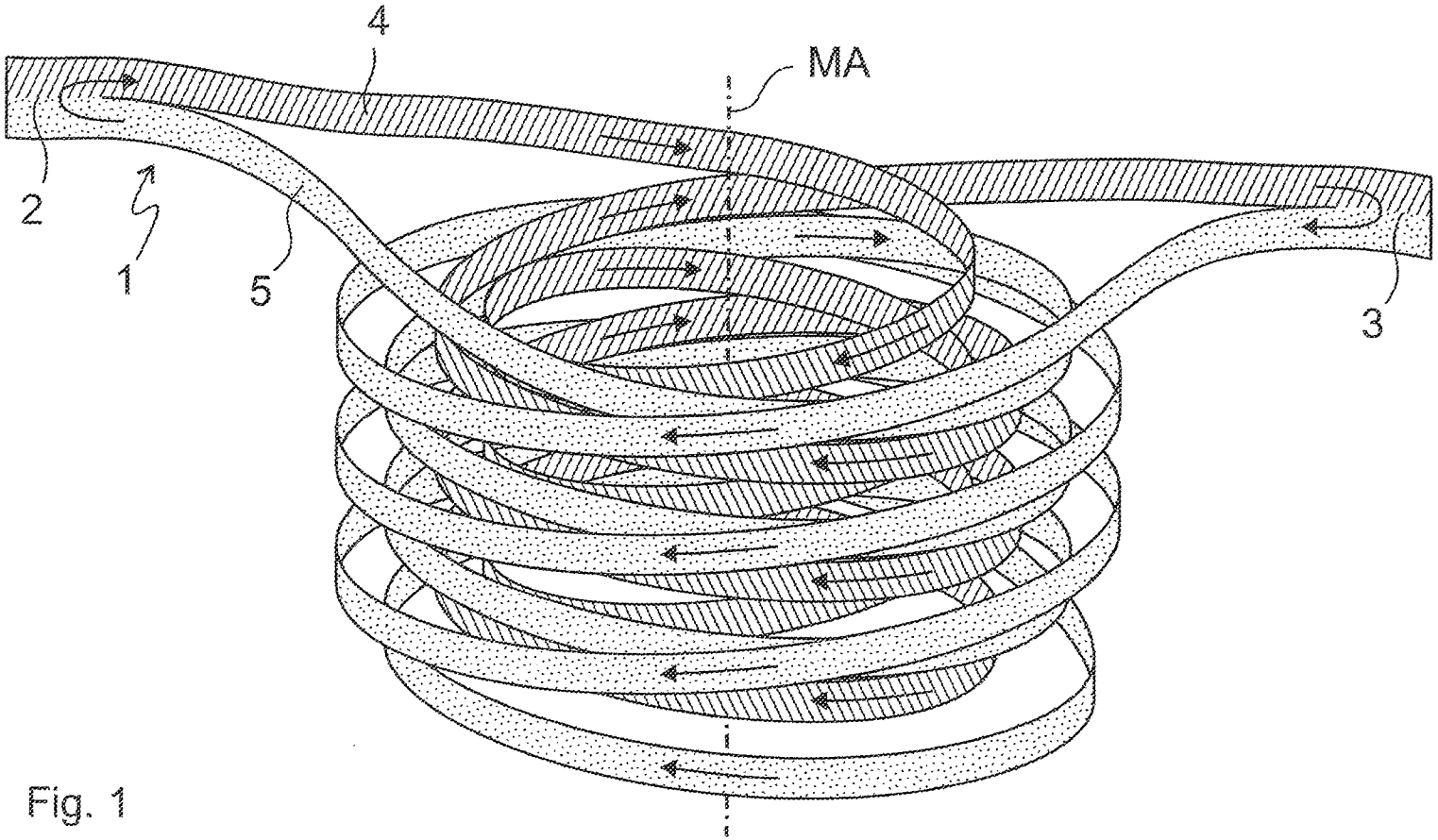
FIG. 1 shows a schematic view of a wound slit band-shaped conductor, as it can be used in an inventive magnet coil configuration.

FIG. 1 schematically shows a band-shaped conductor 1, which bears e.g. a buffer layer of $CeO_2$ on a flexible steel substrate, a superconducting layer of YBCO material, a cover layer (capping layer) of gold and a stabilization layer (shunt layer) of copper. The band-shaped conductor 1 is slit along its longitudinal direction except for two end areas (end sections) 2, 3 such that it is divided into two half bands 4, 5 along the major part of its length. For a better differentiation, a first half band 4 is marked with lines (hatched) and a second half band 5 is marked with dots. This marking is also used in the following figures.

The half bands 4, 5 form a closed conductor loop via the two end areas 2, 3. Within the scope of the invention, the half bands 4, 5 are wound onto a common winding body (not illustrated in FIG. 1) in a fashion described in more detail below, such that a magnet coil configuration is created, in the inside of which a strong homogeneous magnetic field can be generated, which is stable over time.

The two half bands 4, 5 are each helically wound in the present case, wherein the helix of the second half band 5 is arranged radially outside of the helix of the first half band 4 and wherein the helices are positioned coaxially around a magnetic field axis MA. When a closed circular current flows through the conductor loop formed by the conductor 1 (see arrows in FIG. 1), the currents in the two half band helices generate magnetic fields which are identically oriented and strengthen each other. The overall magnetic field in the inside of the magnet coil configuration is substantially parallel to the magnetic field axis MA and is centered with respect to the magnetic field axis MA.

For a better illustration of the individual half bands 4, 5, the winding radius of the second half band 5 is shown on an enlarged scale. In case of tight winding onto a winding body (cf. FIGS. 3*a*, 3*b*, 7, 8), only a slightly larger amount of the half band 5 is wound onto the winding body compared to half band 4, which can be compensated for at the end areas 2, 3, if necessary. It should be noted that the winding length of the two half bands 4, 5 can be made equal through suitable layer sequences (cf. in this connection FIGS. 5*a*-5*d*).

Figure 2:
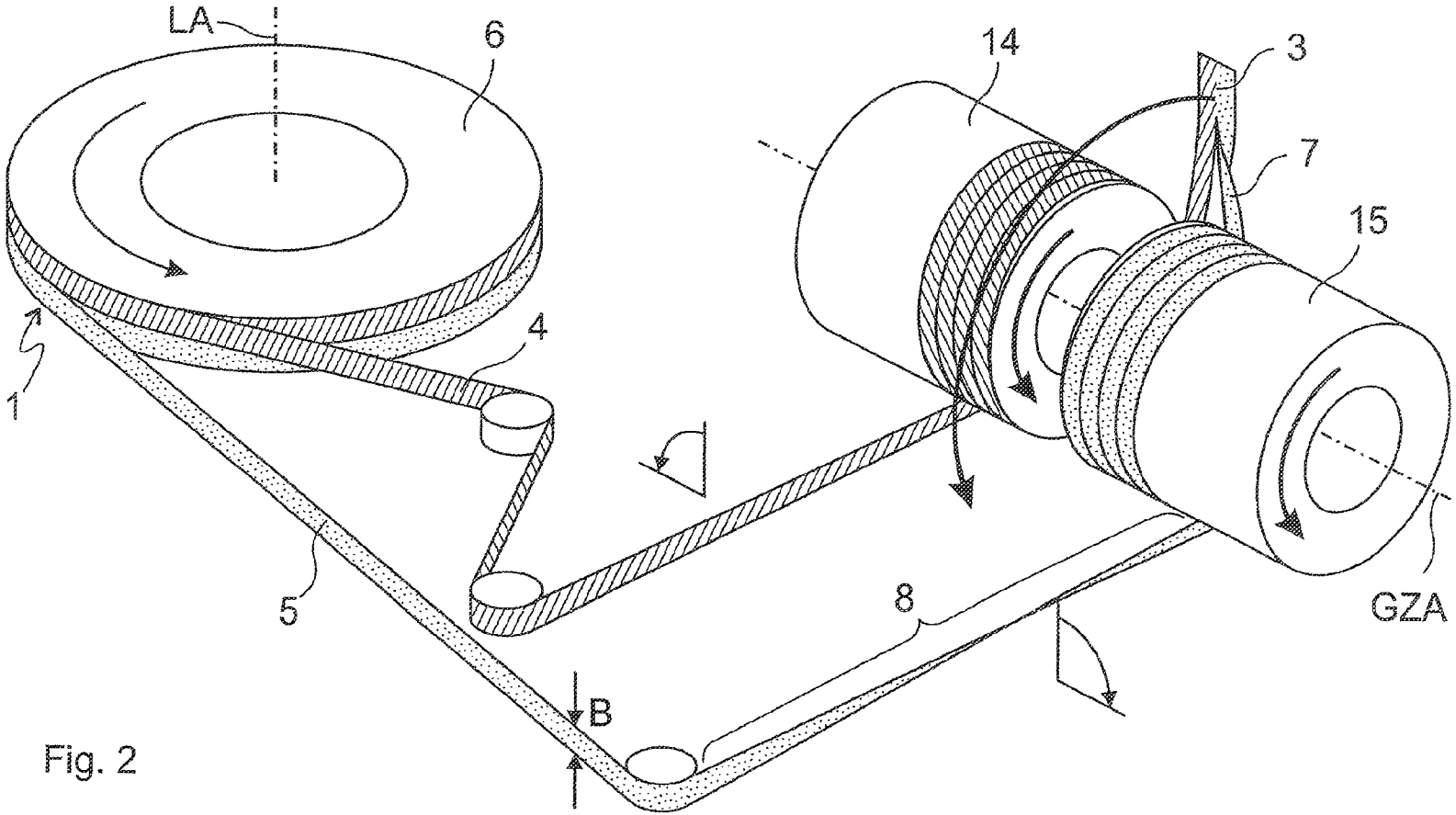
FIG. 2 shows a schematic view of rewinding of a slit band-shaped conductor from a storage coil onto two intermediate coils in accordance with the inventive method.

FIG. 2 shows one possibility of performing step a) of the inventive winding method, i.e. rewinding of the half bands onto two intermediate coils.

The first half band 4 of the previously slit band-shaped conductor 1 is wound onto a storage coil 6 directly next to the second half band 5, the storage coil 6 being designed as flat coil with vertical axis LA in the present case. The length of the prepared slit band-shaped conductor 1 corresponds to the length that is required for the magnet coil configuration to be produced, plus a certain buffer. The two half bands 4, 5 are rewound onto a first intermediate coil 14 and a second intermediate coil 15. The two intermediate coils 14, 15, which are oriented in a horizontal direction in the present case, may be arranged coaxially and be rotated synchronously about their common axis GZA via a common drive (not shown in detail). The storage coil 6 is simultaneously rotated about its axis LA.

The end area (end section) 3 of the band-shaped conductor 1 was applied to the intermediate coils 14, 15 in accordance with the invention such that the half bands are twisted with respect to each other through 180°, (cf. twisted section 7). The twisted section 7 is sufficiently long such that the twisting does not damage the band-shaped conductor 1 (in most cases the length of the twisted section 7 is at least 50 times the width B of a half band). The end area 3 and the twisted section 7 are carried along during each circulation in the area between the intermediate coils 14, 15 or between the converging half bands 4, 5 (cf. the arrow originating in the end area 3).

The half bands 4, 5 are also twisted with respect to each other through a total of 180° in the area of their feed 8. Towards this end, the first half band 4 is tilted through 90° to the left, and the second half band 5 is tilted through 90° to the right. The length of the feed 8 area, in turn, is selected such that mechanical damage of the band-shaped conductor 1 is not to be expected (in most cases the feed 8 length, in the present case from the last deflection roll to the respective intermediate coil surface, is at least 50 times the width B of a half band).

After termination of the rewinding process, the two intermediate coils 14, are tilted in such a fashion that the twisting is cancelled again, wherein in this case, the outer ends of the intermediate coils 14, 15 are each pivoted in an upward direction towards the respective other intermediate coil 14, 15. The inventive twisting in step a) is therefore only temporary.

Figure 3A:
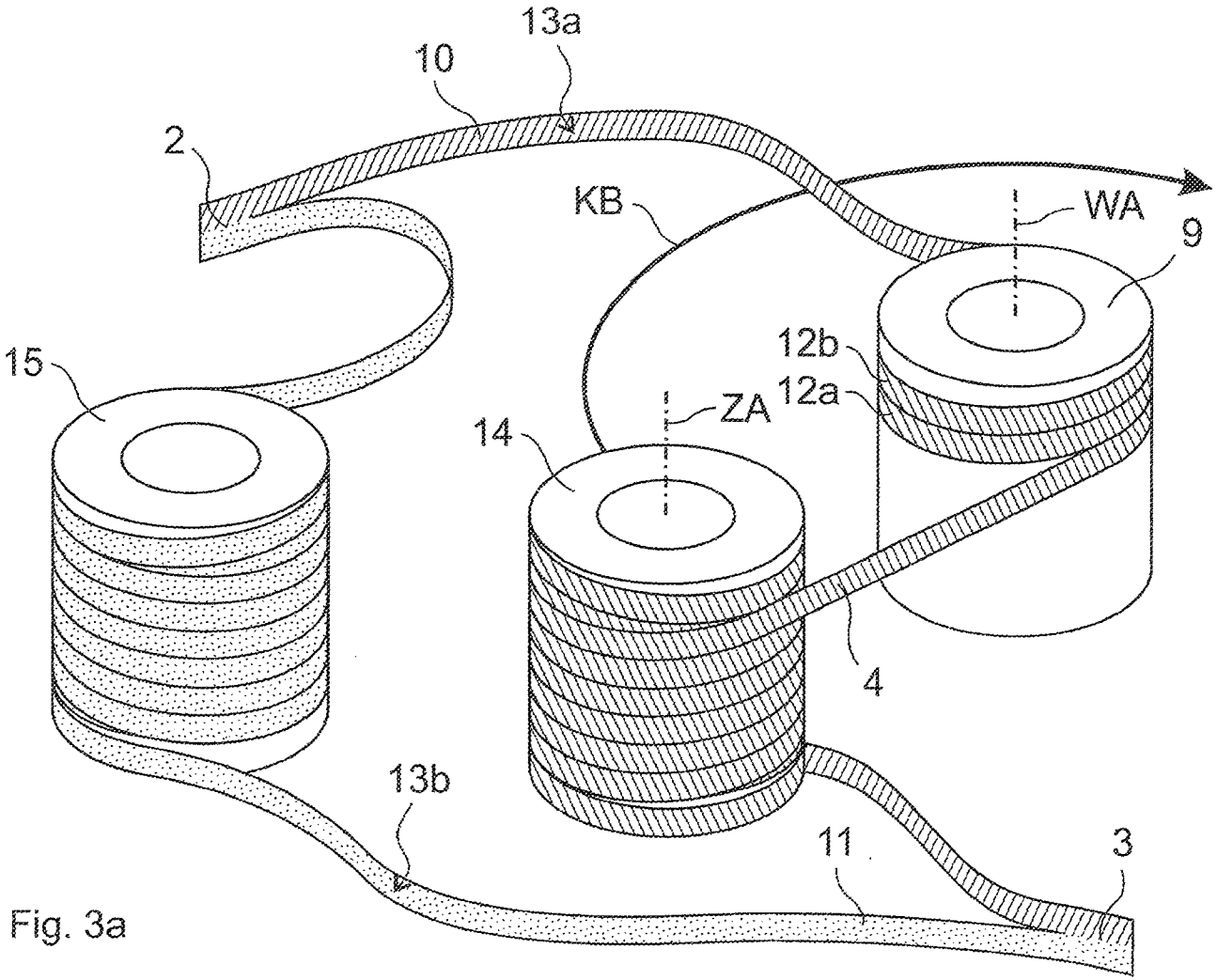
FIG. 3*a* shows a schematic view of winding of a half band from an intermediate coil onto a winding body in accordance with a first variant of the inventive method ("planetary winding")

The half bands can then be wound from the intermediate coils onto a winding body in step b) to form the actual magnet coil configuration. FIG. 3*a* illustrates a first substep b1) in a first method variant ("planetary winding") in this connection.

After applying an end area (in the present case the end area 2) of sufficient section length for play 10 to a winding body 9, the first intermediate coil 14 is pivoted on a circular path KB about the resting winding body 9 (or its axis WA) (see arrow). The intermediate coil 14 and the winding body 9 are thereby oriented in parallel. Half band 4 is wound from the first intermediate coil 14 ("active coil") onto the winding body 9 due to the pivoting motion. The first intermediate coil 14 and the winding body 9 have an approximately identical circumference such that during this movement neither rotation of the first intermediate coil 14 about its axis ZA nor rotation of the winding body 9 about its axis WA are required. The second intermediate coil 15, which is arranged in parallel with the coils 14, 9, is at rest during this rewinding process ("non-active coil").

During one circulation of the first intermediate coil 14, the intermediate coil slips through below a band section 13*a* (comprising the front end area 2 and the section for play 10). In other words, the intermediate coil 14 is axially guided on the inside past the band section 13*a*. A further band section 13*b* (in the present case comprising a section for play 11 and the rear end area 3) which interconnects the intermediate coils 14, 15, is also guided below the winding body 9. The first intermediate coil 14 may be guided and held from below, and the winding body 9 may be held from above.

When the desired number of windings has been wound onto the winding body 9 (in FIG. 3*a*, two windings 12*a*, 12*b* have been completely wound onto the winding body 9 so far), the active (intermediate) coil is changed, i.e. the first intermediate coil 14 then remains at rest and the second intermediate coil 15 then moves on a circular path around the winding body 9 in correspondence with a substep b2).

Figure 3B:
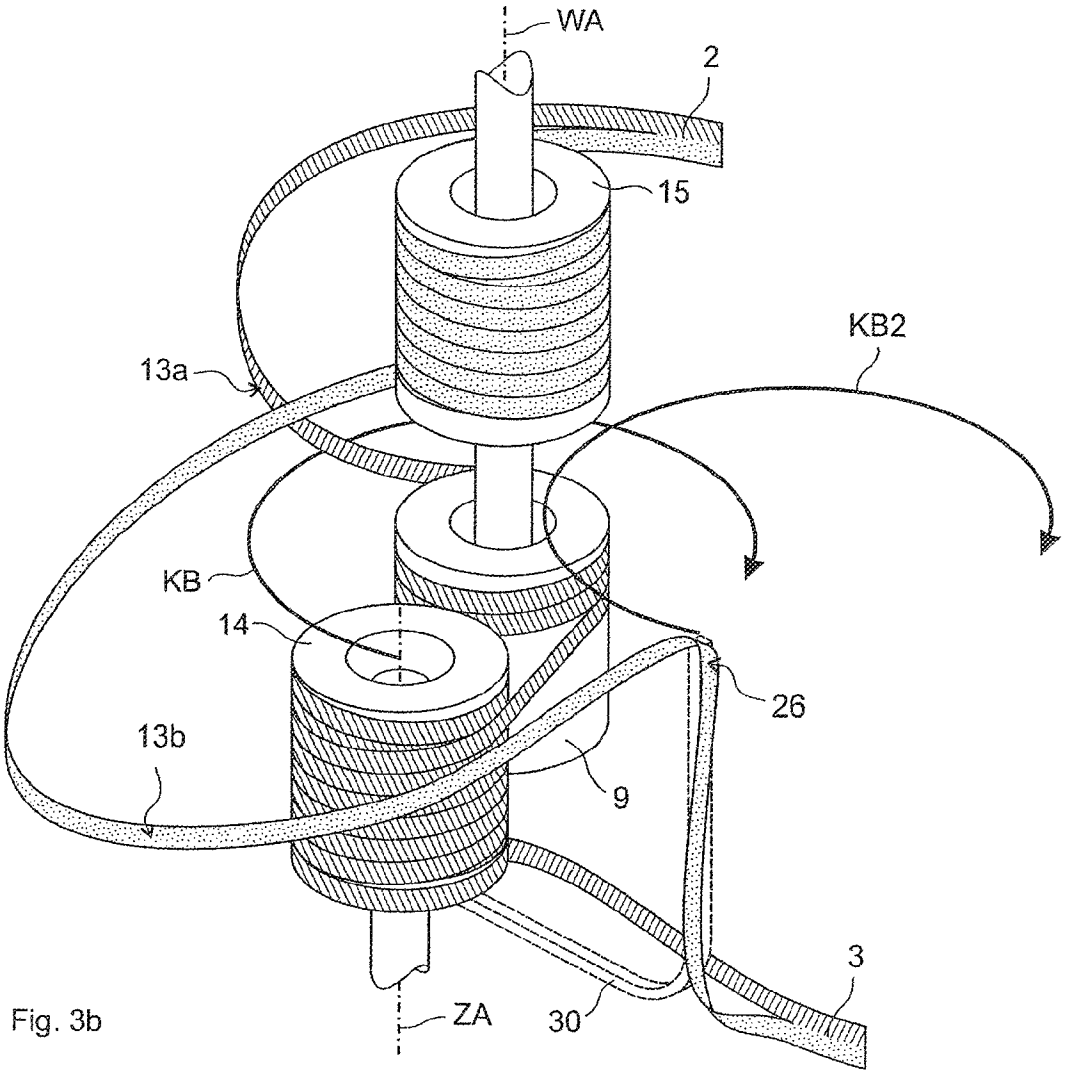
FIG. 3*b* shows a schematic view of a subvariant of the first method variant of FIG. 3*a*, wherein a non-active intermediate coil is arranged axially next to the winding body.

FIG. 3*b* illustrates a subvariant of the first method variant, in which the non-active second intermediate coil 15 is arranged coaxially with respect to and above the winding body 9. The circular motion of the first intermediate coil 14 is marked by the circular line KB. Meanwhile, the other coils 9, 15 remain at rest. Also in this case, the active first intermediate coil 14 slips through below the band section 13*a*, and part of the band section 13*b* in the area between the intermediate coil 14 and the end area 3 is guided along below the winding body 9. The half band is advantageously reinforced between the intermediate coil 14 and the end area 3 to improve guidance, e.g. through mounting to or in a bracket (cf. the bracket 30 in FIG. 3*b*, shown with dotted lines, which holds the half band section 13*b* in the area of a knee 26 in the present case). The remaining part of the band section 13*b* (e.g. between the intermediate coil 15 and the area of the knee 26) is deformed during the circular motion (i.e. its flexibility is utilized). The area of the knee 26 in the band section 13*b* may e.g. follow a circular path KB2, which substantially corresponds to the circular path KB but is radially spaced apart therefrom, whereas the large loop of the band section 13*b* (on the left-hand side at the front in FIG. 3*b*) is narrowed and widened. It should be noted that the knee 26 thereby always remains on the right-hand side in front of the winding body 9.

Figure 4B:
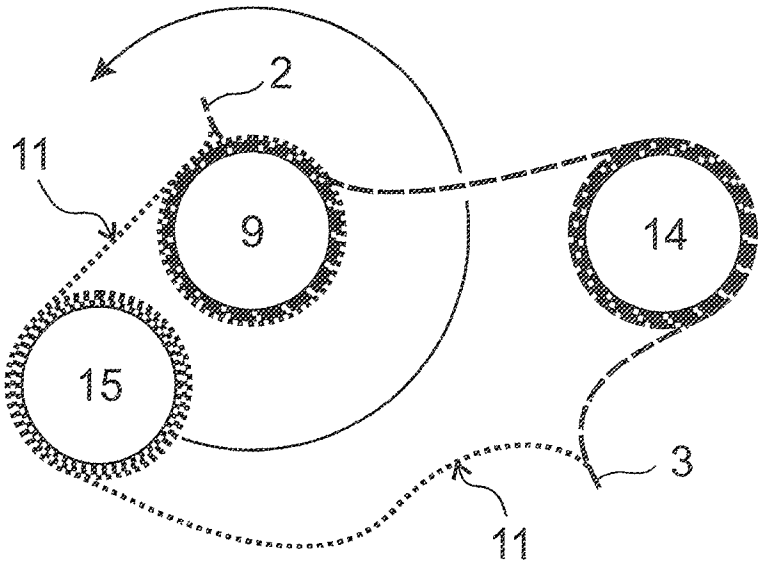
FIGS. 4*a*, 4*b* show schematic top views of winding a half band from the first intermediate coil (FIG. 4*a*) and from the second intermediate coil (FIG. 4*b*) onto the common winding body in accordance with the first variant of the inventive method.
Figure 4A:
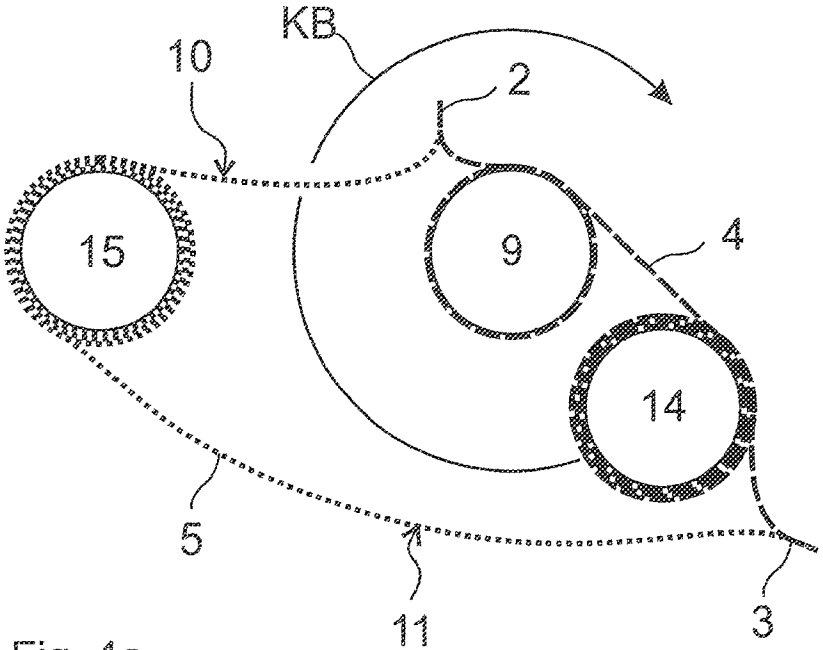

The two substeps b1) and b2) for the first method variant are explained in more detail in the top views of FIGS. 4*a* and 4*b*.

FIG. 4*a* combines the motions of substep b1) explained in FIG. 3*a*: The first intermediate coil 14 moves on the circular path KB around the resting winding body 9, wherein the half band 4 is rewound onto the winding body 9 while the second intermediate coil 15 is at rest.

In substep of b2), illustrated in FIG. 4*b*, the second intermediate coil 15 moves on a circular path KB around the winding body 9, wherein the second half band 5 is rewound onto the winding body 9 while the first intermediate coil 14 is at rest.

In the illustration of FIGS. 3 to 4*b*, the three coils 9, 14, 15 are vertically oriented. It should be noted that all of the coils 9, 14, 15 may also be horizontally oriented. In this variant, all coils 9, 14, 15 are preferably oriented parallel with respect to each other.

FIGS. 5*a* to 5*d* show the different winding schemes which can be applied within the scope of the inventive winding method in order to manufacture corresponding inventive magnet coil configurations. A solid line thereby represents a winding of the first half band 4, and a dotted line represents a winding of the second half band 5.

Figure 5A:
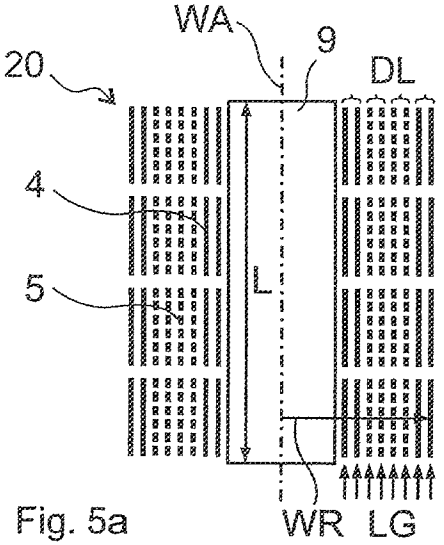
FIGS. 5*a*-5*d* show winding schemes of different inventive magnet coil configurations that can be wound using the inventive method, each having layers that are wound across the overall length of the winding body and wound half bands of identical lengths (FIGS. 5*a*, 5*b*), with half bands that are wound in blocks (FIG. 5*c*), and half bands that are wound without pitch (FIG. 5*d*)

In the winding scheme of the magnet coil configuration 20 of FIG. 5*a*, a double layer DL is initially wound onto the winding body 9 over the entire length L of the winding body 9 using the first half band 4, i.e. a layer LG (including four windings in the present case) is initially helically wound from the upper to the lower end of the winding body 9 and subsequently a further layer LG is helically radially wound on top of this layer from the lower end to the upper end. Two double layers DL are subsequently wound using the second half band 5 and finally another double layer DL using the half band 4. A sequence of substebs b1)-b2)-b1) is thereby applied. The sequence of the (in the present case altogether eight) layers LG from the inside to the outside in a scheme N/2N/N (with N: number of wound layers LG in one substep, also called basic number of layers, in the present case N=2. The slash "/" separates the substeps) causes equal consumption of the first and the second half band 4, 5, thereby approximately taking into consideration the increase in circumference with increasing winding radius. FIG. 5*a* shows by way of example the winding radius WR (measured from the winding body axis WA) of the radially outermost layer LG. The scheme may also be written for each layer LG individually, in the present case approximately as EEZZZZEE (with E: layer of the first half band, Z: layer of the second half band).

Figure 5B:
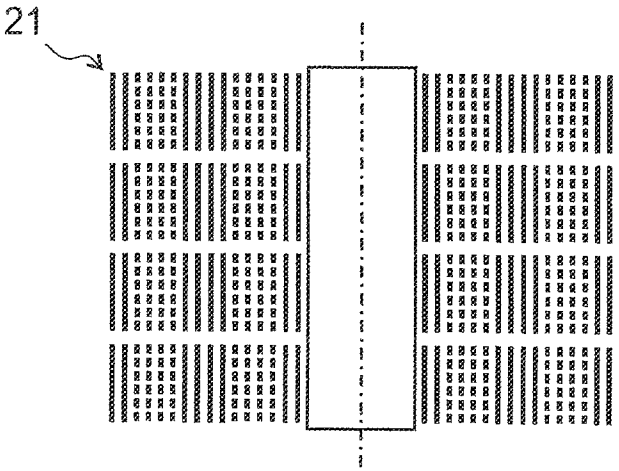

It is also possible to use the layer sequence N/2N/N several times in succession (or on top of each other), as shown in the magnet coil configuration 21 in FIG. 5*b*, where this layer sequence has been applied twice on top of each other (in each case with N=2). It should be noted that N may also be differently selected in different layer sequences.

In the magnet coil configurations 20, 21 in accordance with FIGS. 5*a* and 5*b*, layers LG of the first and of the second half band 4, 5 are radially wound on top of each other in accordance with the invention.

Figure 5C:
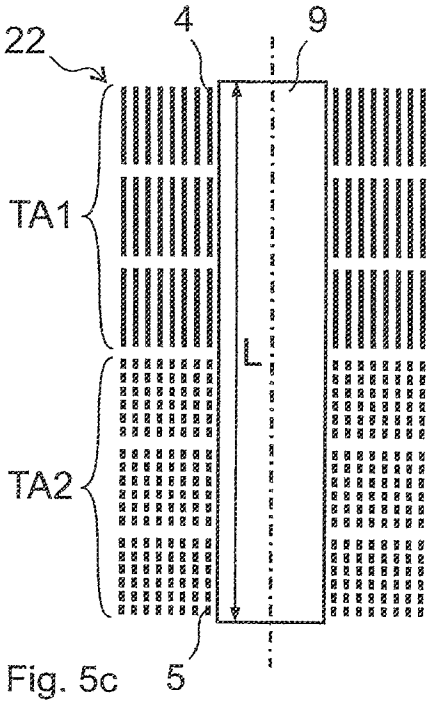

The magnet coil configuration 22 of FIG. 5*c* utilizes winding in blocks. Four double layers of the first half band 4 (each comprising three windings) were wound across one first section TA1 in accordance with half the length L of the winding body 9. Moreover, four double layers of the second half band 5 (also each comprising three windings) were wound across a further section TA2 in correspondence with the remaining half of the length of the winding body 9. This magnet coil configuration 22 can be wound with a substep sequence b1)-b2), i.e. with only one change of the active coil (on the occasion of which the section to be wound is also changed). Alternatively, several changes are possible, e.g. in each case after winding a layer or a double layer of a half band 4, 5.

Figure 5D:
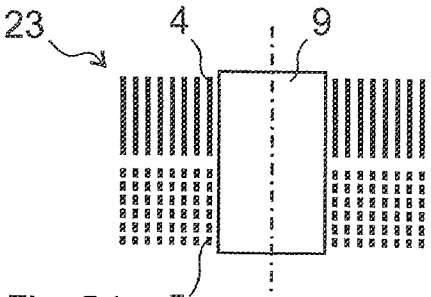

FIG. 5*d* shows a magnet coil configuration 23, which is wound as a double flat coil (i.e. without helical pitch). The two flat coil parts of the first half band 4 and the second half band 5, which are wound onto the same winding body 9, are typically produced with only one change of the active coil.

Figure 6:
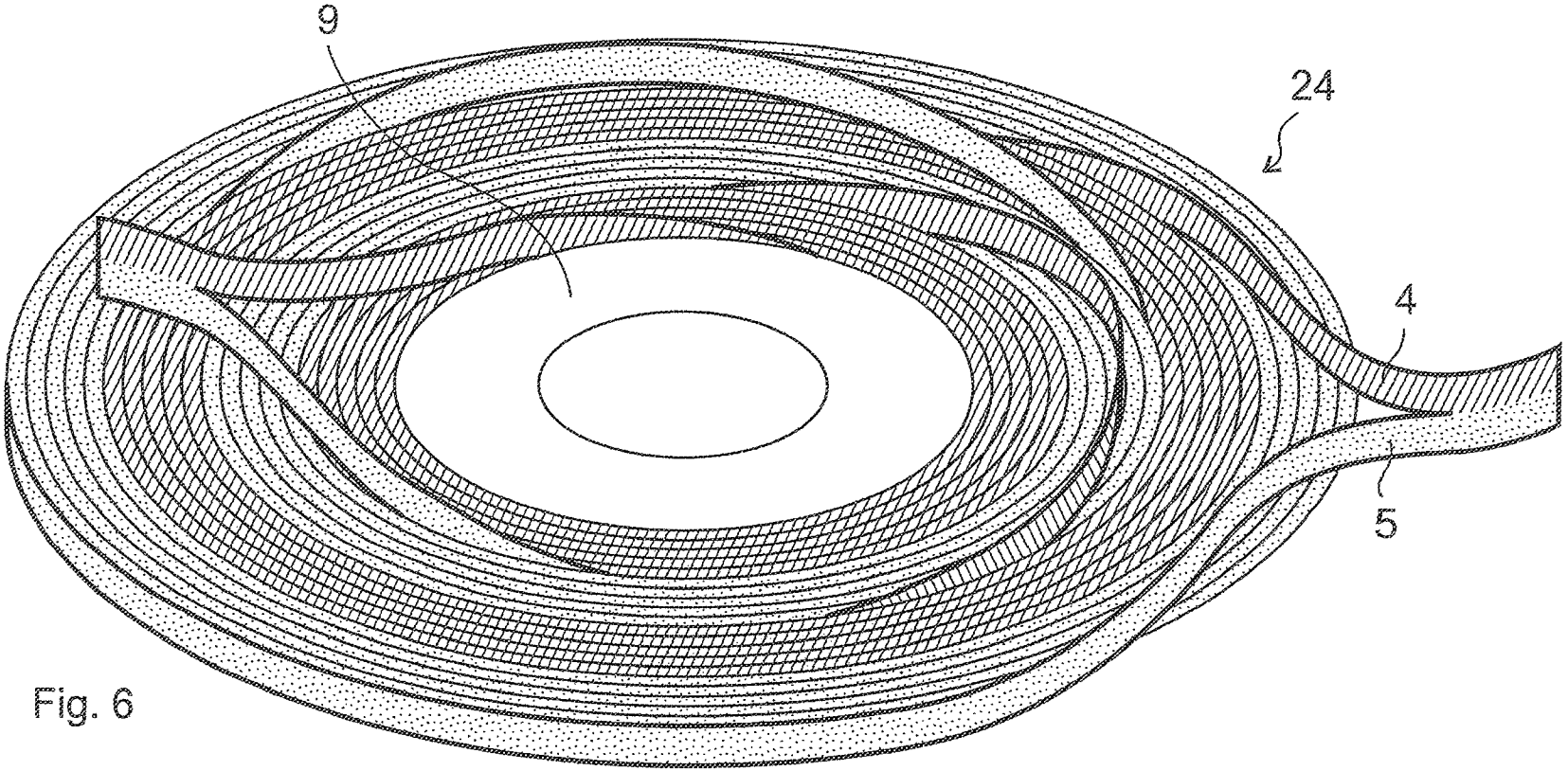
FIG. 6 shows a schematic view of an inventive magnet coil configuration which is wound in accordance with the inventive method from four winding packages which are each wound from one half band and are disposed radially on top of each other, including half band passages between corresponding blocks.

FIG. 6 schematically shows the front end of a magnet coil configuration 24 of the type of a layer-wound solenoid, wherein layers of the first and of the second half band 4, 5 are radially wound on top of each other, including connecting sections. A first half band 4 is wound in the radially innermost winding package (which is directly supported on the winding body 9), the second half band 5 is wound in the outer next winding package, the first half band 4 is again wound in the outer next winding package, and the second half band 5 is finally again wound in the radially outermost winding package. The layer sequence (from the inside to the outside) is in this case N/N/N/N, which produces a relatively simple sequence of connecting sections. The connecting sections (between the respective next but one winding packages of the same half band or at the end areas) are marked with bold lines so that they can be better distinguished.

Figure 7:
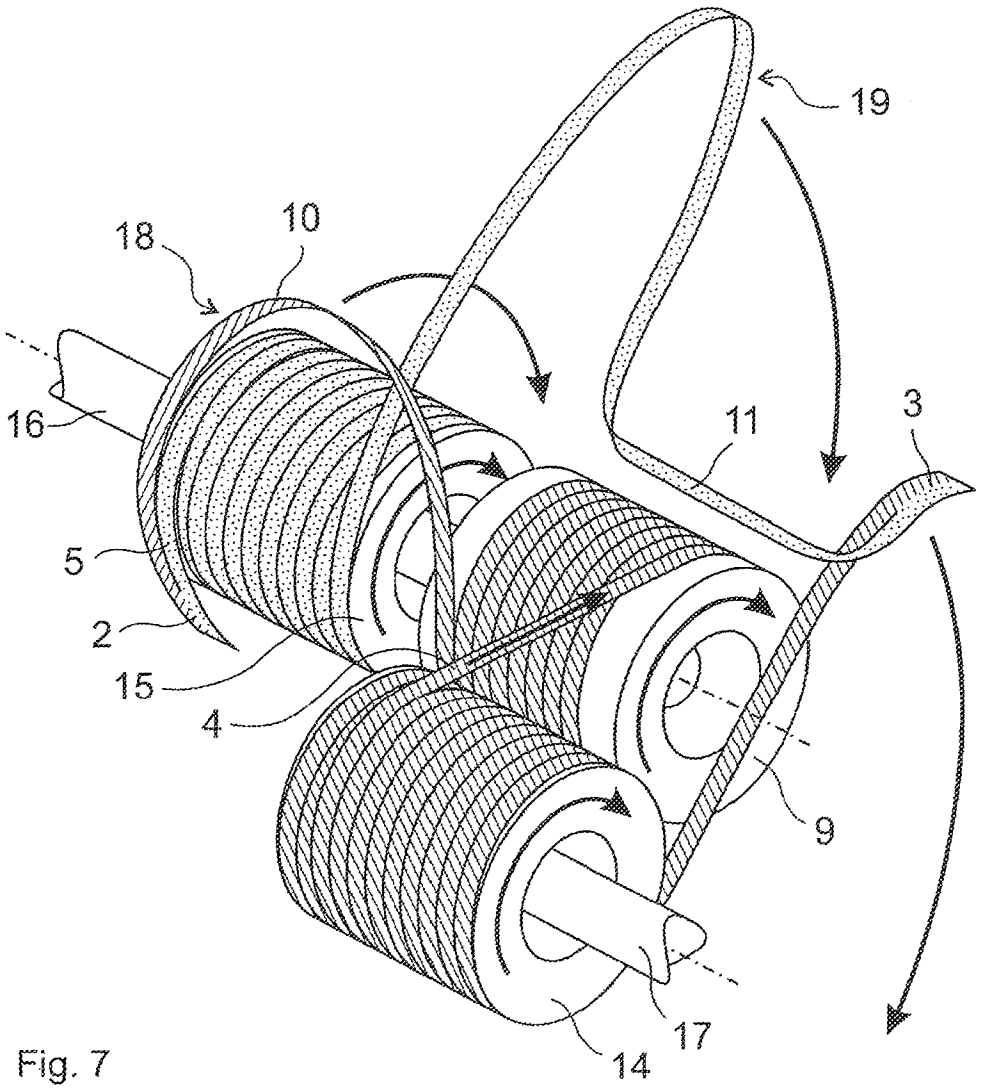
FIG. 7 shows a schematic view of winding a half band from an intermediate coil onto a winding body in accordance with a second variant of the inventive method with horizontal coils ("synchronous rotation")

FIG. 7 shows a second winding variant of the first half band 4 from the first intermediate coil 14 onto the winding body 9 (also called winding core) in a substep b1) within the scope of "synchronous rotation".

In this case, the first intermediate coil 14 and the winding body 9 are arranged parallel with respect to each other but at a radial separation from each other. The second intermediate coil 15 is arranged coaxially with respect to the winding body 9. The intermediate coils 14, 15 and the winding body 9 are oriented in a horizontal direction in this case.

The second intermediate coil 15 and the winding body 9 (in the following also "coils 15, 9") are held and mechanically coupled via a holder 16 that is illustrated on the left-hand side in FIG. 7. This holder 16 is also able to activate common rotation of the coils 15, 9. The first intermediate coil 14 is held via a holder 17 shown on the right-hand side in FIG. 7, which can also activate rotation synchronous with the coils 15, 9. All intermediate coils 14, 15 and the winding body 9 have approximately identical circumferences.

The front end area 2 is applied to the winding body 9 (thereby taking into consideration a section for play 10). For rewinding the first half band 4 from the first intermediate coil 14 ("active coil") and onto the winding body 9, the first intermediate coil 14 and also the two coils 15, 9 are rotated (in the present case in a clockwise direction).

A band section 18 (containing the end area 2 and the half band section for play 10 close to this end area 2) of the band-shaped conductor 1, which connects the second (non-active) intermediate coil 15 to the winding body 9, is simply guided along with the circulating coils 15, 9, wherein the band section 18 is typically held radially close to the two coils 15, 9. A further band section 19 (containing the end area 3 and the half band section for play 11 close to this end area 3), which connects the two intermediate coils 14, 15, is guided once around the winding body 9 and the section of the half band 4 between the first intermediate coil 14 and the winding body during each circulation of the first intermediate coil 14 (which also respectively exactly corresponds to a circulation of the coils 15, 9). The band section 19 thereby passes the winding body 9 on its right-hand side (i.e. axially next to the winding body 9, on the side facing away from the second intermediate coil 15).

During rewinding of the first half band 4 from the first intermediate coil 14 and onto the winding body 9, the band sections 18, 19 remain at the same length. There is no unwinding or winding action at the connections between the two intermediate coils 14, 15 or between the non-active intermediate coil 15 and the winding body 9.

For changing the active coil, i.e. for changing from a substep b1) to a substep b2), the first and the second intermediate coil 14, 15 may change their places. During rewinding of the second half band 5 in substep b2), rotation is effected in a counter-clockwise direction.

It should be noted that in subsequent substeps b1), b2), a half band section that connects the non-active intermediate coil and the winding body 9 generally no longer has an end area. Starting from the front end area 2, both the first half band 4 and the second half band 5 have already been wound onto the winding body 9 such that this end area 2 is then fixed to the winding body 9 (see also FIG. 6).

Figure 8:
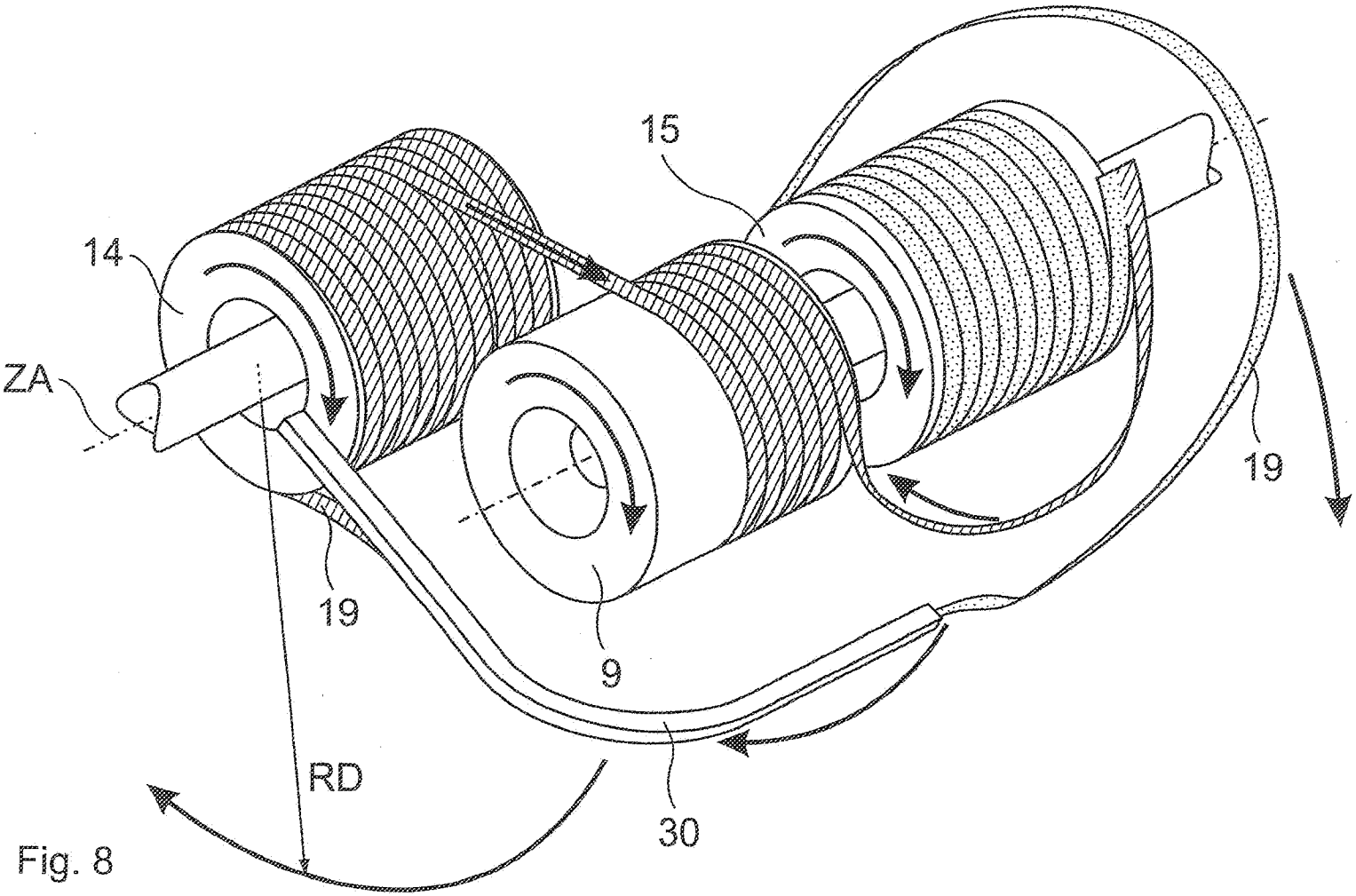
FIG. 8 shows a schematic view of winding a half band from an intermediate coil onto a winding body in accordance with the second variant using a bracket.

FIG. 8 illustrates an auxiliary construction for the winding variant presented in FIG. 7 as a part of substep b1) with rotating active intermediate coil, in the present case the first intermediate coil 14, and rotating winding body 9 ("synchronous rotation"), which can be used within the scope of the invention for facilitating the proceedings and, in particular, preventing the band sections from becoming entangled.

A bracket 30 is rigidly mounted to the first intermediate coil 14, which rotates together with the intermediate coil 14 about the intermediate coil axis during rotation of the intermediate coil 14. The band section 19 which interconnects the two intermediate coils 14, 15 is carried along with the bracket 30 (and partially within the bracket 30).

In this case, the bracket 30 initially extends radially away from an axial end of the intermediate coil 14, which faces away from the second intermediate coil 15, and then extends in an axial direction over at least the major part of the length (and preferably over the entire length or even beyond) of the winding body 9 towards the second intermediate coil 15. The space through which the bracket 30 pivots during circulation of the intermediate coil 14 has a sufficiently large radius RD to permit pivoting around the winding body 9.

The bracket 30 therefore securely guides the band section 19 axially on the side of the winding body 9 past its side facing away from the non-active second intermediate coil 15 during each circulation of the first intermediate coil 14. FIG. 8 shows the bracket 30 in exactly this position. The band section 19 is also guided axially on the side of the first intermediate coil 14 past its side facing the non-active second intermediate coil 15 during each circulation of the intermediate coil 14. This is performed in a position of the bracket 30, which is pivoted through approximately 180° with respect to the position illustrated in FIG. 8.

FIGS. 9*a* through 9*h* illustrate the temporal progression of a circulation of the active intermediate coil 14 on a circular path KB around the resting winding body 9 within the scope of the first method variant based on the "planetary winding" (cf. FIG. 3*a* as viewed from below) in a schematic end-face view. The band section 13*b* interconnects the two intermediate coils 14, 15.

Figures 9A, 9B, 9C, 9D, 9E, 9F, 9G, 9H:
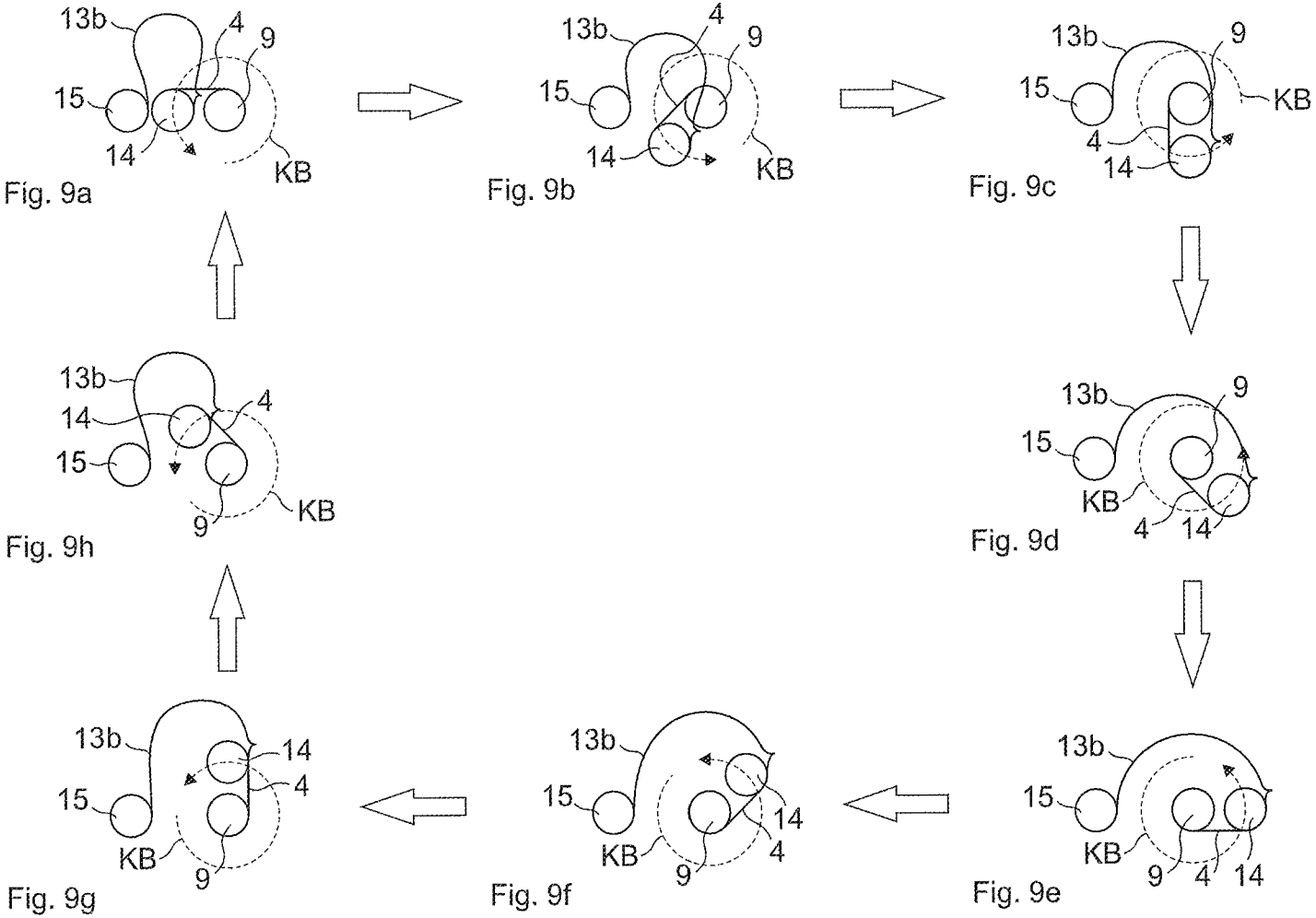
FIGS. 9*a*-9*h* show schematic views of the temporal progression of winding a half band from an intermediate coil onto a winding body in accordance with the first variant via circulation of the intermediate coil.

The half band 4 is unwound from the intermediate coil 14 by the movement of the intermediate coil 14 on the circular path KB and wound onto the winding body 9. The second intermediate coil 15 and the winding body 9 are at rest. FIG. 9*b* shows how the band section 13*b* is axially guided past the winding body 9.

FIGS. 10*a* through 10*h* furthermore illustrate the temporal progression of a circulation of the active intermediate coil 14 on the circular path KB around the resting winding body 9 in the subvariant of the first method variant (cf. FIG. 3*b*, again as viewed from below). The non-active intermediate coil 15 is arranged behind the winding body 9 and is therefore covered in the figures.

The end area 3 is guided by a bracket 30 which is mounted to the active coil 14. The radial position of the end area 3 approximately corresponds to the position of the knee (reference numeral 26 from FIG. 3*b*) (cf. the circular path KB2 in this respect).

Figure 10A:
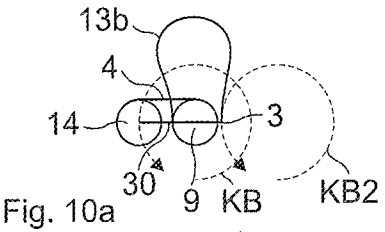
FIGS. 10*a*-10*h* show schematic views of the temporal progression of winding a half band from an intermediate coil onto a winding body in accordance with the subvariant (FIG. 3*b*) of the first variant via a circulation of the intermediate coil.
Figure 10B:
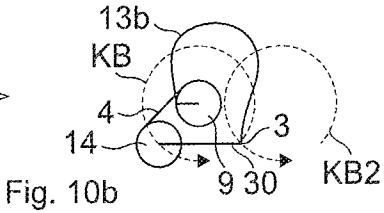
Figure 10C:
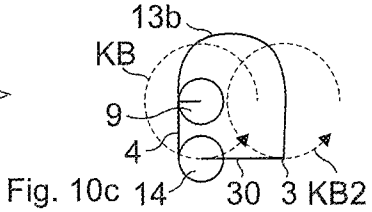
Figure 10D:
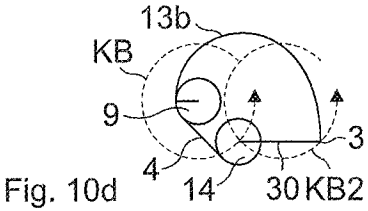
Figure 10E:
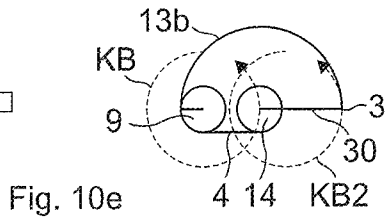
Figure 10F:
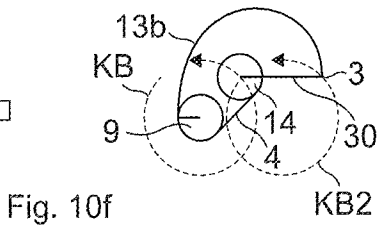
Figure 10G:
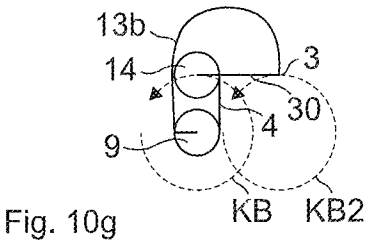
Figure 10H:
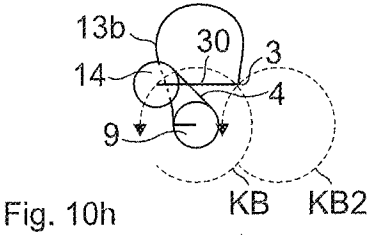

Passing on from FIG. 10*h* to FIG. 10*a* and FIG. 10*b*, these show how part of the band section 13*b*, namely in the area of the bracket 30, is guided past the winding body 9. The remaining band section 13*b*, similar to a large loop, is only narrowed and widened, but not guided past the area of the winding body 9.

FIGS. 11*a* through 11*h* schematically illustrate an end-face view of the temporal progression of a rotational circulation of the active intermediate coil 14 within the scope of "synchronous rotation", wherein the band section 19 is guided by means of a bracket 30 (cf. FIG. 8 as viewed from the left-hand side from the front). The band section 19 connects the first intermediate coil 14 and the second intermediate coil 15 which is arranged behind the winding body 9 and is covered by it in FIGS. 11*a*-11*h*.

Figure 11A:
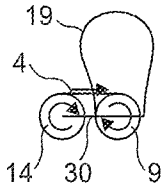
FIGS. 11*a*-11*h* show schematic views of the temporal progression of winding a half band from an intermediate coil onto a winding body in accordance with a second variant via full rotation of the intermediate coil, with horizontal coils.
Figure 11B:
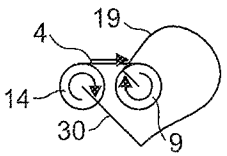
Figure 11C:
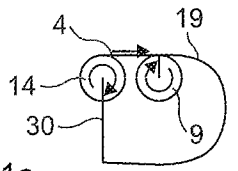
Figure 11D:
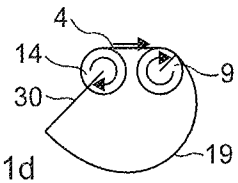
Figure 11E:
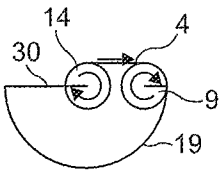
Figure 11F:
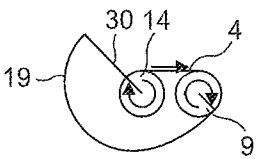
Figure 11G:
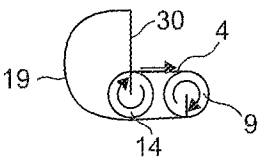
Figure 11H:
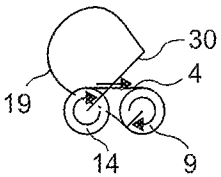

The half band 4 is rewound from the intermediate coil 14 onto the winding body 9 (see arrow) during synchronous rotation of the winding coil 14 and the winding body 9. The bracket 30 moves in correspondence with the rotation of the intermediate coil 14. In FIG. 11*a*, the band section 19 is just guided axially on the side past the winding body 9, and in FIG. 11*h*, the band section 19 is just axially laterally guided past the active first intermediate coil 14 (dot behind the intermediate coil 14).

Figure 12:
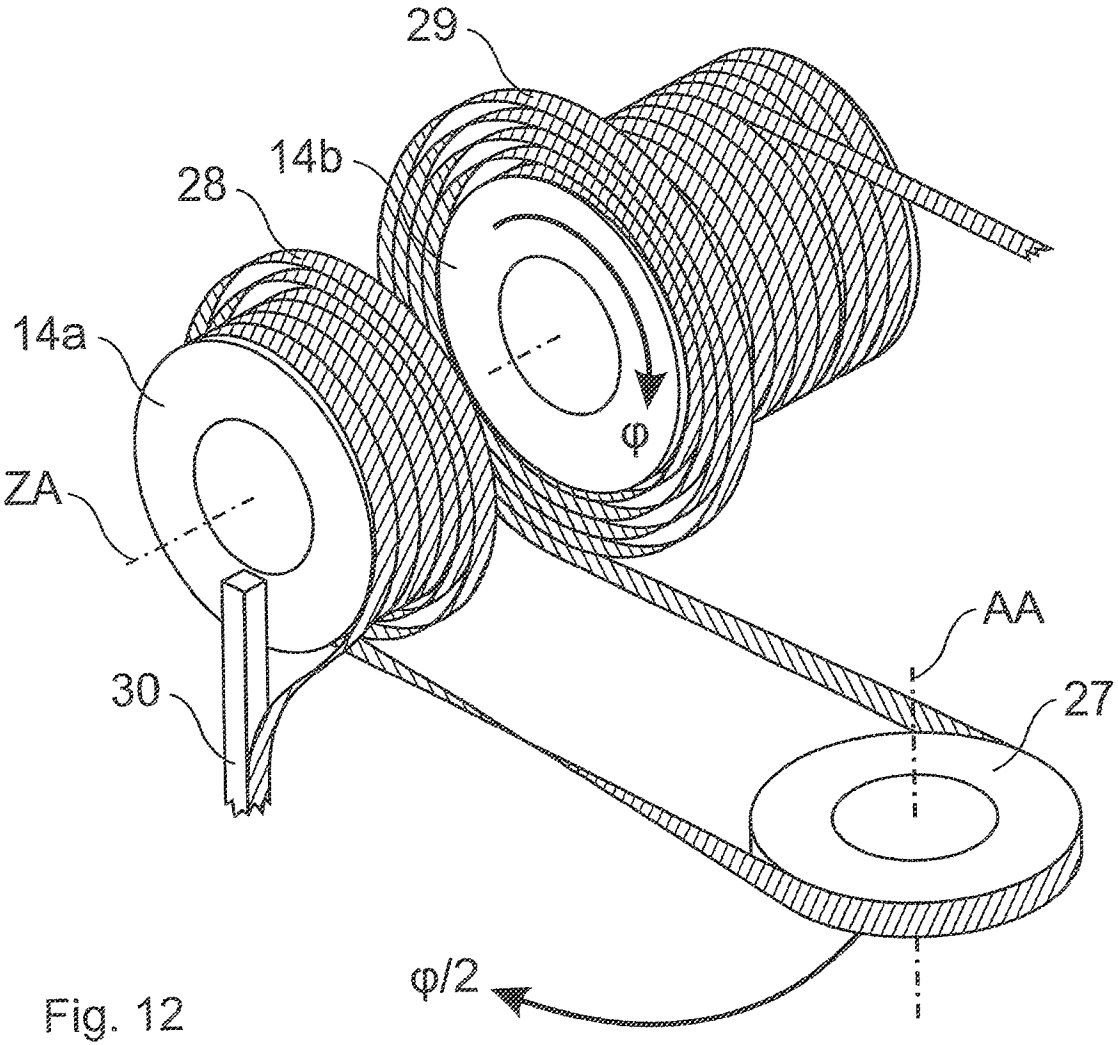
FIG. 12 shows a schematic view of a compensating mechanism for differing numbers of revolution of intermediate coil and winding body during an inventive winding process due to considerably changing winding radii.

Small winding radius differences between the active coil and the winding body, which result e.g. from the height of the half band that has been previously wound or unwound, may be compensated for in the presented winding method through variable tightening of the band section between the active coil and the winding body. It is also possible to track the radial separation between active coil and winding body for compensation. FIG. 12 illustrates a compensating mechanism which also compensates for large winding radius differences. The compensating mechanism is explained by means of the example of "synchronous rotation".

During "synchronous rotation", the active intermediate coil and the winding body should be rotated synchronously. In particular, a bracket 30 for guiding a band section that interconnects the two intermediate coils, should rotate strictly synchronously with respect to the winding body in order to prevent knotting.

The compensating mechanism of FIG. 12 divides the active intermediate coil into an end area 14*a* and a main area 14*b*. The end area 14*a*, to which the bracket 30 is also mounted, is rotated in strict synchronism with the winding body 9. The main area 14*b*, however, may have a slightly different rotational speed (indicated by the additional rotation $\phi$, see arrow). The two areas 14*a* and 14*b* are connected via a compensation wheel 27, which guides the band and can be rotated about a compensation wheel axis AA that is perpendicular to the intermediate coil axis ZA. The compensation wheel 27 is thereby hinged via a transmission (not shown) in such a fashion that it rotates with approximately half the rotational speed difference, i.e. $\phi/2$ (see arrow) around the intermediate coil axis ZA. The separation from the intermediate coil axis ZA and also the relative angular position (tilting) is thereby fixed. A flat compensation coil 29 is provided at the edge of the main area 14*b* and a flat compensation coil 28 is provided at the edge of the end area 14*a*.

The half band is transferred from the main area 14*b* to a winding body (not illustrated) during a winding process. Due to the larger winding radius of the intermediate coil, which is initially still full compared to the still empty winding body, the main area 14*b* must initially rotate at a slower speed than the winding body and the end area 14*a*. For this reason the half band is transferred from the flat compensation coil 29 via the compensation wheel 27 onto the flat compensation coil 28. Approximately starting from the middle of the winding process, when the winding radius on the winding body has the same size and is then larger than the winding radius on the intermediate coil, the main area 14*b* must rotate at a higher speed than the winding body and the end area 14*a*. The half band is then again transferred from the flat compensation coil 28 via the compensation wheel 27 onto the flat compensation coil 29. The overall returned half band can finally also be wound onto the winding body. Suitable control systems or mechanisms ensure that the desired tensile stresses are always maintained in the half band during the winding process.

The half band length, which must be provided on the flat compensation coil 29 at the start of the winding process, substantially corresponds to the length difference generated during half of the winding process, which would result from the differing winding radii due to the wound heights on the intermediate coil and on the winding body with the same rotational speed (assuming identical winding radii without band).

The flat compensation coils 28, 29 avoid spreading of the half band in the area of the feeds to the compensation wheel 27 during the winding process.

A corresponding mechanism can also be used for "planetary winding", wherein in this case, the end area does not rotate around itself in this case, and the main area slightly rotates around itself. The main area and the end area move together on a circular path around the resting winding body.

LIST OF REFERENCE NUMERALS

1 Band-shaped conductor
2, 3 end areas of the band-shaped conductor
4 first half band

5 second half band
6 storage coil
7 twisted section
8 feed
9 winding body
10, 11 sections for play
12*a*, 12*b* windings
13*a*, 13*b* band sections
14 (first) intermediate coil
14*a* end area of the intermediate coil
14*b* main area of the intermediate coil
15 (second) intermediate coil
16, 17 holders
18, 19 band sections
20-24 magnet coil configurations
26 knee
27 compensation wheel
28, 29 flat compensation coils
30 bracket
AA axis of the compensation wheel
B width of the half band
DL double layer
GZA common axis of the intermediate coils
KB circular path
KB2 circular path
L length of the winding body
LA axis of the storage coil
LG layer
MA magnetic field axis
N basic number of layers
RD radius of the space through which the bracket is pivoted
TA1 first section
TA2 further section
WA axis of the winding body
WR winding radius
ZA axis of the intermediate coil
ϕ additional rotation

We claim:

1. A method for manufacturing a magnet coil configuration from a band-shaped conductor, the band-shaped conductor being slit in a longitudinal direction except for two end areas thereof such that the band-shaped conductor has a first and a second half band and two end areas which connect those first and second half bands to form a closed loop, the method comprising the steps of:

a) winding the first half band of the slit band-shaped conductor onto a first intermediate coil and the second half band of the slit band-shaped conductor onto a second intermediate coil;

b) winding one or more windings of the first half band from the first intermediate coil onto a winding body of the magnet coil configuration; and c) winding one or more windings of the second half band from the second intermediate coil onto the winding body, wherein steps b) and c) are alternately performed.

2. The method of claim 1, wherein steps b) and c) are alternated at least twice or at least four times.

3. The method of claim 1, wherein, in step a), the first and second half bands are each helically wound with a plurality of axially neighboring windings onto the first and second intermediate coils, wherein circumferences of said first and said second intermediate coils are selected to be substantial equal to a circumference of the winding body.

4. The method of claim 1, wherein, in step a), the first and second intermediate coils are simultaneously wound, the first and second intermediate coils thereby being disposed substantially coaxially and being synchronously rotated.

5. The method of claim 1, wherein, in step a), an end area, which connects the first and second half bands, moves between the first and second half bands during each rotation of the first and second intermediate coils.

6. The method of claim 1, wherein, in at least one of steps b) and c), a plurality of axially neighboring windings are helically wound onto the winding body to form at least one layer with at least five axially neighboring windings for each layer.

7. The method of claim 6, wherein, in at least one of steps b) and c), one or several double layers of the first or second half band are wound from a respective first or second intermediate coil onto the winding body of the magnet coil configuration.

8. The method of claim 6, wherein, in at least one of steps b) and c), one or more layers are wound onto the winding body over a full axial length thereof.

9. The method of claim 6, wherein, in step b), one or more layers are wound onto the winding body only through a first section of an axial length of the winding body and, in step c), one or more layers are wound only through a further section of the axial length of the winding body.

10. The method of claim 6, wherein, in steps b) and c), layers of the first and second half bands are radially wound on top of each other onto the winding body.

11. The method of claim 1, wherein, prior to step a), the first and second half bands are twisted with respect to each other at one of the end areas or are twisted through a total of 180° and are applied in such twisted form to the first and second intermediate coils, and, after step a), the first and second intermediate coils are tilted with respect to each other such that the twisting of the first and second half bands in the end area is cancelled.

12. The method of claim 1, wherein, in step a), the slit band-shaped conductor is unwound from a storage coil on which the first and second half bands are arranged axially next to each other, wherein the storage coil is a flat coil.

13. The method of claim 1, wherein, during steps b) and c), the first and second intermediate coils and the winding body are substantially aligned in parallel.

14. The method of claim 1, wherein, the first intermediate coil is arranged coaxially with respect to the winding body and is mechanically coupled to the winding body and the second intermediate coil is arranged parallel to the winding body at a radial separation therefrom, the second half band being rewound from the second intermediate coil onto the winding body through rotation of the winding body together with the first intermediate coil and synchronous rotation of the second intermediate coil, wherein, with each rotation of the winding body, a band section, which connects the first and the second intermediate coils, is guided once axially outside past the winding body on a side facing away from the first intermediate coil and is guided once axially outside past the second intermediate coil on a side facing the first intermediate coil.

15. The method of claim 1, wherein the first intermediate coils is guided on a circular path relative to the winding body, while the second intermediate coil remains at rest, wherein, with each circulation, a band section of the conductor, which connects the first and second intermediate coils, is axially guided once past an outside of the winding body, and wherein, with each circulation, the first intermediate coil is axially guided on an inside past a band section of the conductor, which connects the second intermediate coil and the winding body.

16. A magnet coil configuration wound from a band-shaped conductor which is slit in a longitudinal direction except for two end areas thereof such that the band-shaped conductor has a first and a second half band and two end areas which connect these half bands to form a closed loop, the magnet coil configuration is wound using the method of claim 1, at least one winding of the first half band and at least one winding of the second half band being wound onto a common winding body.

17. The magnet coil configuration of claim 16, wherein the slit band-shaped conductor has a high-temperature superconducting material or a YBCO-coated conductor.

18. The magnet coil configuration of claim 16, wherein the first and second half bands are helically wound in layers onto the winding body, each layer comprising a plurality of axially neighboring windings or at least five axially neighboring windings.

19. The magnet coil configuration of claim 18, wherein layers of the first and the second half band are radially wound onto the winding body on top of each other.

20. The magnet coil configuration of claim 18, wherein a radial sequence of layers of the first half band and of the second half band is selected such that approximately a same length of first half band and second half band has been wound in the layers of the magnet coil configuration, the radial sequence containing one or more sections in which N layers of the first half band, subsequently 2N layers of the second half band, and subsequently again N layers of the first half band are disposed in radial sequence, with N: basic number of layers of the section, wherein $N \in \mathbb{N}$.

* * * * *